US005289642A

United States Patent [19]

Sloan

[11] Patent Number: 5,289,642

[45] Date of Patent: Mar. 1, 1994

[54] PORTABLE DRYER

[76] Inventor: Charles W. Sloan, 97 5th Ave., 5A, New York, N.Y. 10003

[21] Appl. No.: 42,667

[22] Filed: Apr. 5, 1993

[51] Int. Cl.[5] ..... F26B 25/00

[52] U.S. Cl. ..... 34/104; 34/243 R; 34/91

[58] Field of Search ..... 34/104, 105, 21, 151, 34/239, 243 R, 90, 91

[56] References Cited

U.S. PATENT DOCUMENTS

| | | | |
|---|---|---|---|
| 2,076,735 | 4/1937 | Leindorf | 34/104 |
| 3,154,392 | 10/1964 | Littman | 34/104 |
| 4,171,580 | 10/1979 | Vabrinskas | 34/104 |
| 4,768,293 | 9/1988 | Kaffka | 34/104 |
| 5,003,707 | 4/1991 | Chu | 34/104 |
| 5,179,790 | 1/1993 | Poulos | 34/104 |

OTHER PUBLICATIONS

Page 7 Snow Country magazine Oct. 1991 Air Dry Systems ad.

Air Dry Systems brochure.

Outdoor Retailer magazine Aug. 1992 Lomeli Enterprises ad.

*Primary Examiner*—Henry A. Bennet

*Assistant Examiner*—Denise Gromada

*Attorney, Agent, or Firm*—Lilling & Lilling

[57] ABSTRACT

The device consists of a Portable Dryer for drying the interior of articles, such as ski boots, ski gloves, etc. It includes articulated tubing that can be forced all the way into the toe portion of the ski boot. At the other end of the articulated tubing is a distribution connector for connecting to a suitable means of forcing air through the tubing and into the interior of the ski boot for drying purposes.

6 Claims, 5 Drawing Sheets

FIG. 2
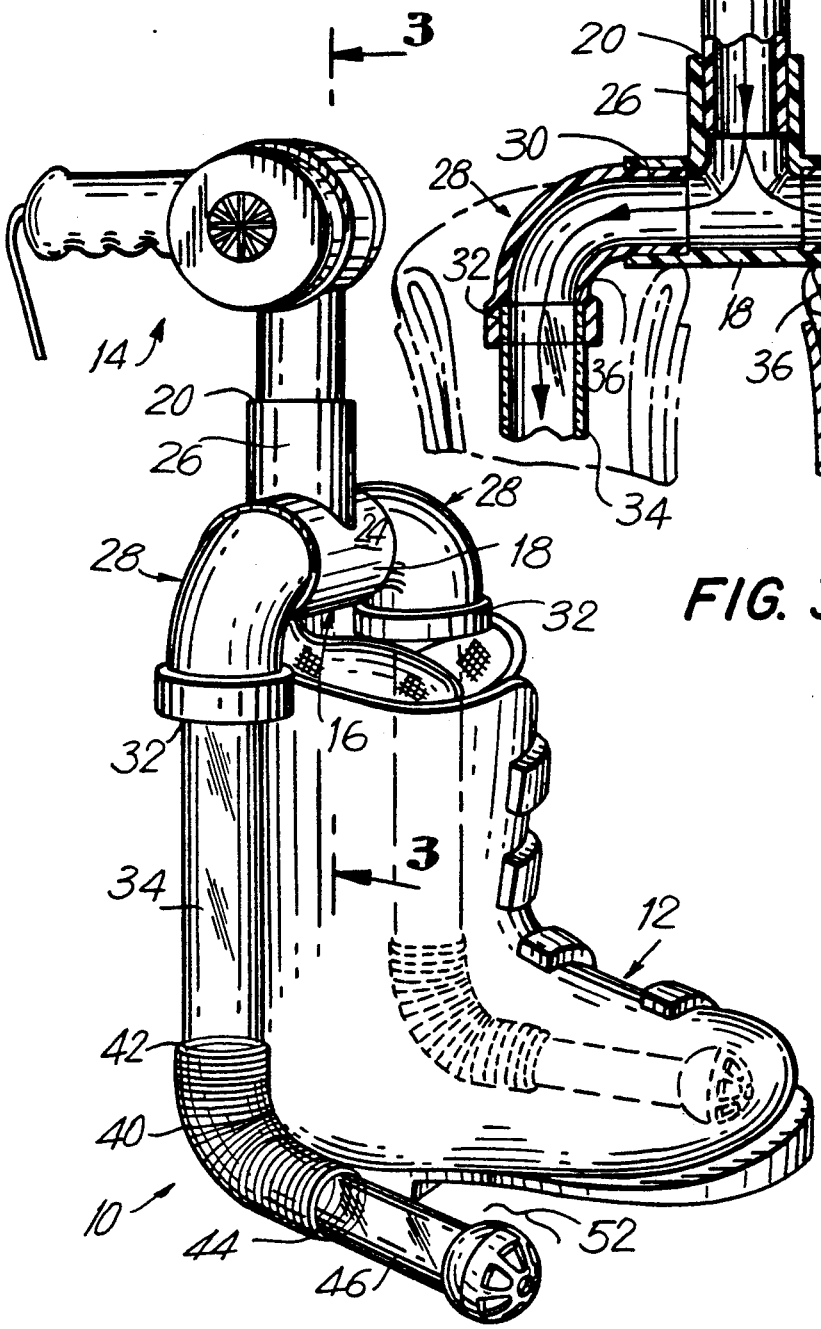
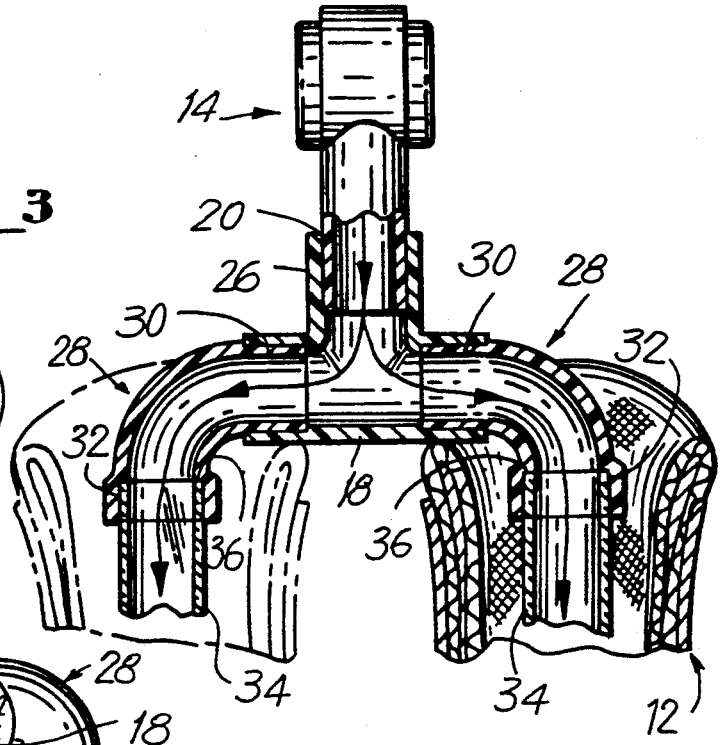
FIG. 3

PORTABLE DRYER

FIELD OF THE INVENTION

The invention relates to a portable dryer that may be used for drying wet ski boots, gloves and other articles of clothing.

BACKGROUND OF THE INVENTION

A persistent problem with ski boots, and some other ski equipment, is that after a day of skiing, the insides of the boots can become wet or moist. This may be due to sweating of the feet and possibly also due to moisture seeping in through the outer shell or lining of the ski boot. It therefore becomes quite important for the boot to be dried by the following day, so that it may be reused.

Devices on the market for this purpose are not adequate. Air Dry Systems of Avon, Colo. has a device for drying the insides of ski boots (Snow Country, October 1991 Page 7 and August 1992 brochure). The problem with this device is that it consists only of flexible tubing, and the tubing cannot extend far enough into the boot to do a proper job of drying the inside of the boot.

Lomeli Enterprises of Milpitas, Calif. sells a footwear dryer that includes plain ordinary hosing that is attached to a standard hair dryer to dry the inside of boots. It suffers from the same problem as the air dry device in that the flexible tubing cannot be forced sufficiently far into the boot to do a proper job of drying the inside of the boot (August 1992 issue of outdoor retailer magazine).

Therefore, while there are devices that proport to be able to thoroughly dry the inside of ski boots, in practice they are not entirely efficient. Thus, there is still a need in the industry for a portable device for efficiently and quickly drying the insides of ski boots.

SUMMARY OF THE INVENTION

It is an object of the invention to provide a portable dryer that may be used for quickly and efficiently drying the inside of ski boots and other articles of clothing.

The device consists of articulated tubes, which can be forced entirely within the ski boot. The tubes are assembled so that they can be levered from the heel and slid into the toe portion of the boot. The other end of the articulated tubes are connected by semi rigid tubing to a device for delivering air to the inside of the boot. This device thus permits the flow of air to the entire inside portion of the boot and to permit an efficient and effective thorough drying of the inside of the ski boot.

In its simplest embodiment the device may include a hair dryer with a fan and a low wattage heating coil. This can then deliver air through the semi rigid tubing and articulated tubing to the inside of the ski boot.

BRIEF DESCRIPTION OF THE DRAWINGS

FIG. 2 is a side perspective view of the invention, and showing one of the articulated tubes inserted in a ski boot.

FIG. 3 is a cross-sectional view of the invention taken along the line 3—3 of FIG. 2.

DETAILED DESCRIPTION OF THE INVENTION

Figure 1:
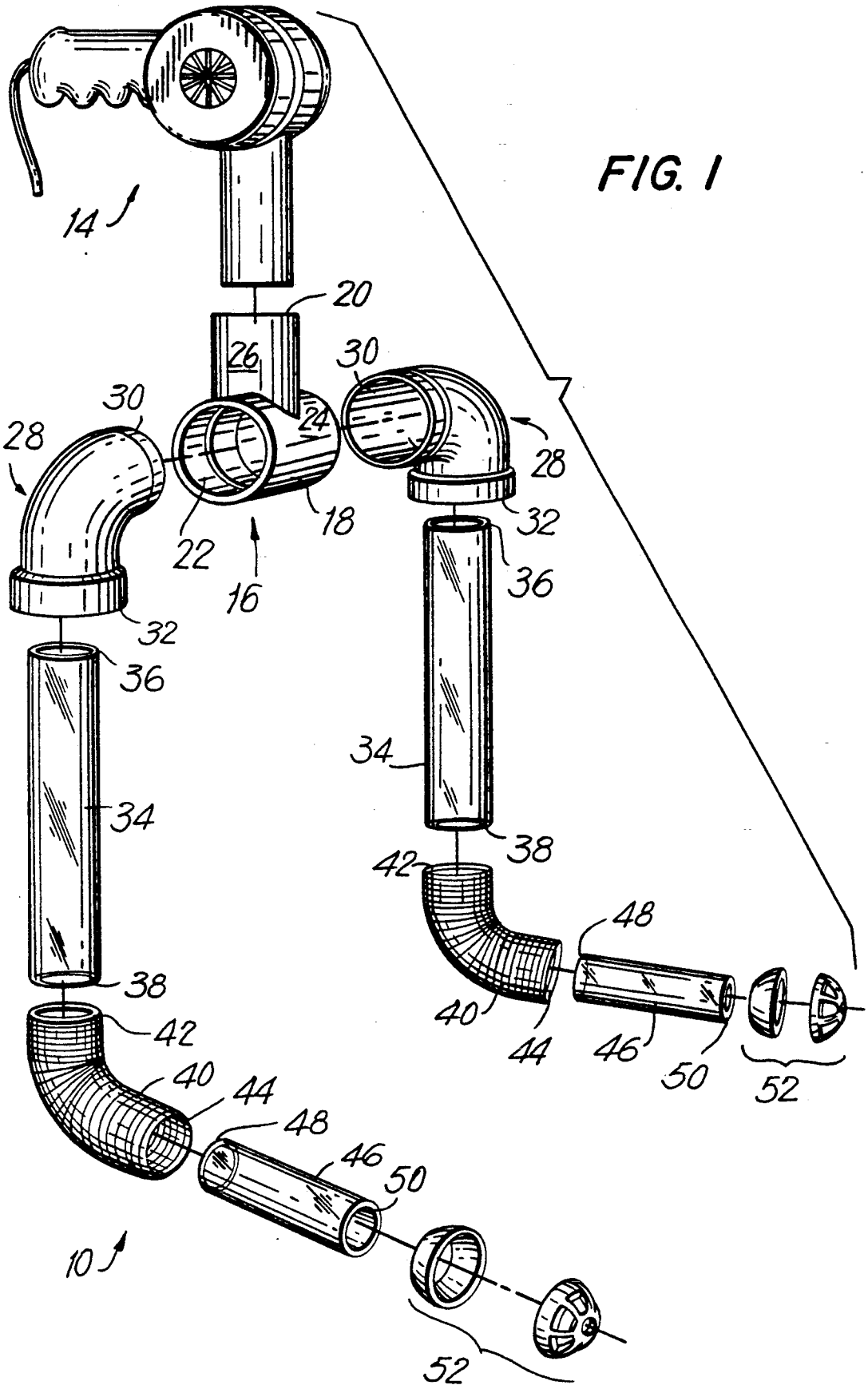
FIG. 1 is an exploded perspective view of the invention.
Figure 4:
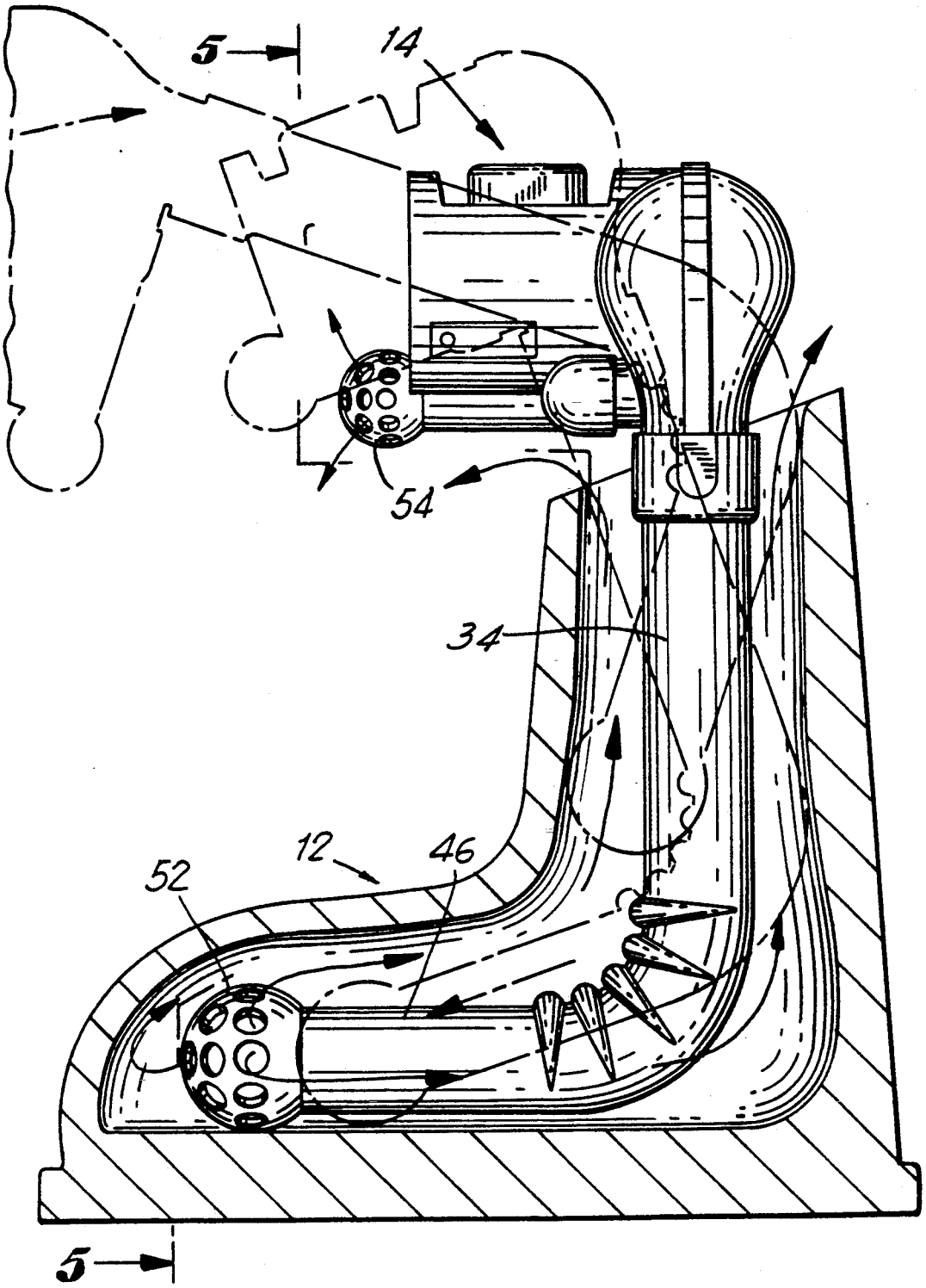
FIG. 4 is a side view of the invention, broken away, to illustrate the manner in which the invention is inserted inside a ski boot.
Figure 5:
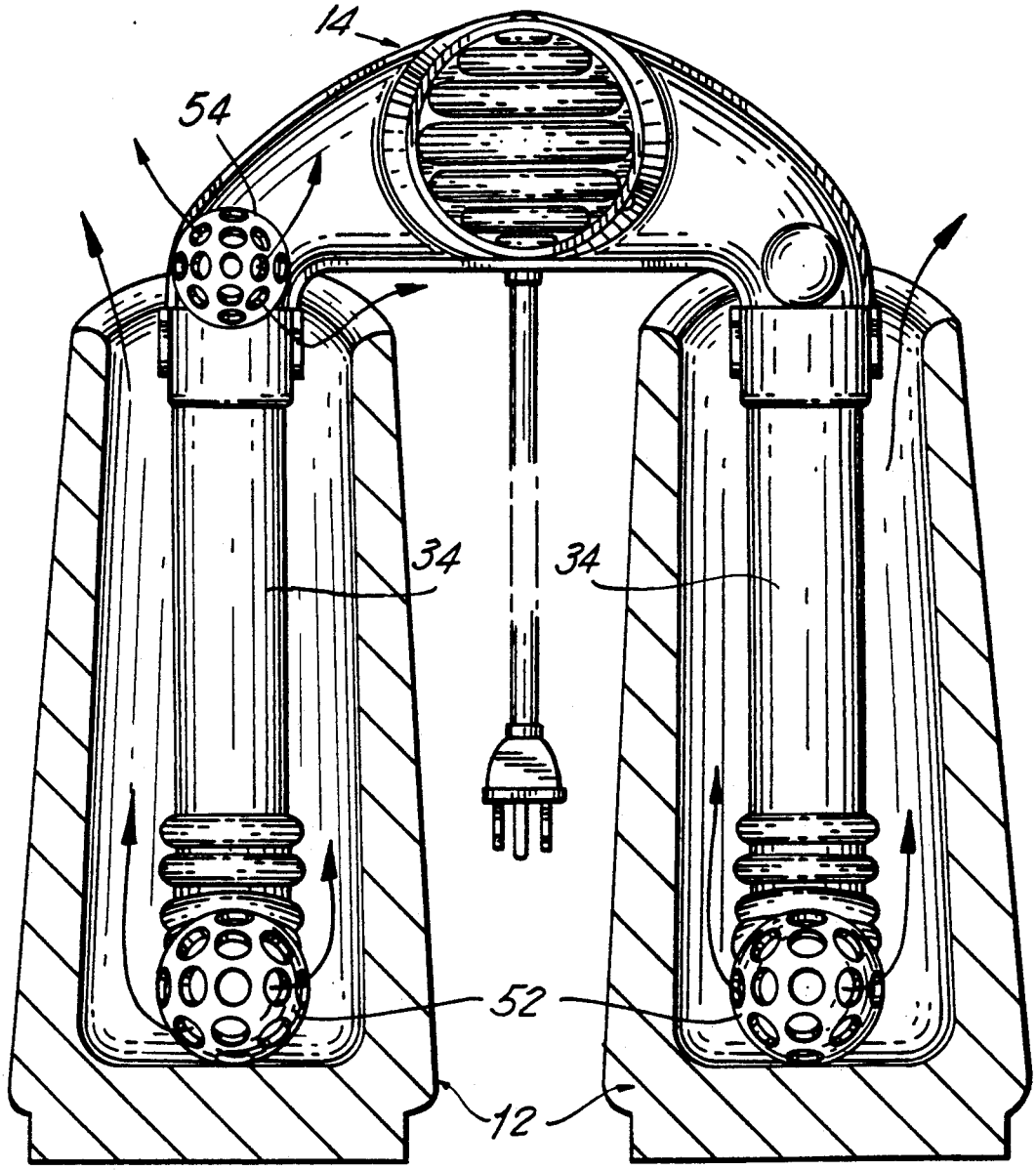
FIG. 5 is a cross-sectional view taken along the line 5—5 of FIG. 4.
Figure 6:
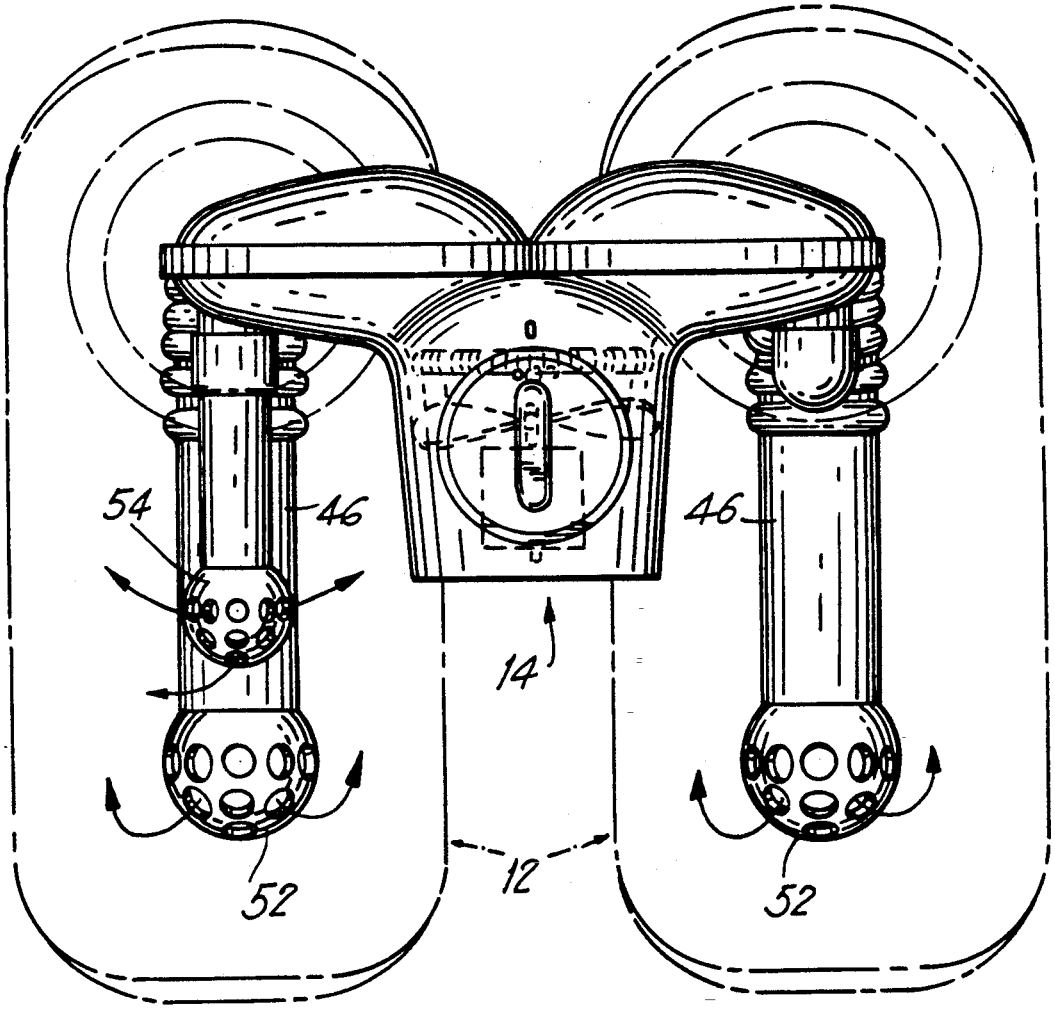
FIG. 6 is a top plan view of the invention.

In its simplest configuration, the invention consists of an air means 14 and a distribution means 10 for distributing the air within a ski boot 12 or other article to be dried. While the invention is described and disclosed in connection with drying the inside of ski boots, it should be appreciated that it is equally applicable and useful for drying the inside of skates, ski gloves, ski hats and other articles of clothing. Further, the device could be used for non-apparel and can be used for any physical device that as an internal opening and has need for the interior to be dried.

The distribution means 10 first includes a collar 16 with a plurality of openings. This collar 16 includes a T-shaped connector 18. An opening 20 of the connector 18 is used to provide communication with the air means 14 and the openings 22 are used to provide communication with the tubes and hoses that extend into the article to be dried.

As shown in the preferred embodiments, the central or main portion 24 of the connector 18 is of a round or circular profile. This simplifies the connection of the tubes and hoses, but it may be appreciated that the central portion 24 may be made of any suitable cross sectional profile. The opening 20 for connection to the air means 14 can be located anywhere along the outer surface of the central portion 24. As shown in the preferred embodiment, an inlet tube 26 is made integral with the central portion 24 and the opening 20 is provided at the end of the inlet tube 26 for communication with the air means. In some embodiments, the inlet tube may be eliminated. Depending on the arrangement of the device will depend the orientation of the opening 20 and the inlet tube 26. In some situations it may be desirable for the opening 20 and the inlet tube 26 to be oriented in a vertical plane (FIG. 1) and in other situations in a horizontal plane may be more suitable.

The distribution means 10 next includes a plurality of shoulder connectors 28. The preferred embodiment shows two shoulder connectors 28, as typically two boots at a time would be dried. In some embodiments there may be three or more such connectors or possibly only a single connector. There is no limitation to the number of shoulder connectors 28, provided that the air means 14 has a sufficiently large capacity to provide the flow of air through all of the connected articles to be dried.

The shoulder connectors 28 are shown with a rounded profile in the drawings and with a circular cross section. They can be made of any desirable cross section, as long as it is compatible with the cross sectional shape of the central portion 24 of the collar 16 and with the tubes and hoses that are to be used in the device. If desired, the shoulder connectors 28 could be made as a right angle coupling, but this may in some situations interfere with the proper flow of air. The rounded profile generally provides for a better distribution and flow or air without unnecessary resistance.

An upper opening 30 in the shoulder connectors 28 communicates with the respective opening 22 of the central portion 24 of the collar 16. This may be done in any suitable manner. As shown in the preferred embodiment, the inside diameter of the side openings 22 of the central portion 24 are slightly greater than the outer diameter of the upper openings 30 of the shoulder connectors 28. In this way, the shoulder connectors can be frictionally held within the central portion 24. Alternatively, the inside diameter of the upper openings 30 of the shoulder connectors 28 can be made slightly larger then the outer diameter of the side openings 22 of the central portion 24. Such a construction could obviously work as well. If desired, different types of connectors can be used to secure these two elements together. Because it is generally desirable for this device to be capable of being disassembled for easy packing, it is generally sufficient for the shoulder connector to be frictionally connected with the central portion 24.

The next piece is the upper tube 34. There should be a corresponding upper tube 34 for each shoulder connector 28. In the preferred embodiment, there are two upper tubes 34—one for each of the shoulder connectors 28.

It may also be appreciated that in some embodiments the central portion 24 of the connector 18 can have rounded ends and the shoulder connector 28 may be incorporated directly into the central portion. This would dispense with the need for the shoulder connectors and would permit the upper tubes 34 to be connected directly to the central portion 24 of the connector 18.

The upper tubes 34 are simple round tubes with a cross sectional shape compatible with the shape of the shoulder connectors 28. A top opening 36 of the upper tube 34 is connected with the lower opening 32 of the shoulder connector 28. This may be done in the same manner as was described above in connection with the communication between the shoulder connectors 28 and the central portion 24. In particular, the inside diameter of the lower opening 32 of the shoulder connector 28 may be made slightly larger than the outer diameter of the top opening 36 of the upper tube 34. This permits the upper tube 34 to be frictionally held within the shoulder connector 28. Similarly, the reverse may be accomplished, and the inside diameter of the top opening 36 of the upper tube 34 may be made slightly larger then the outside diameter of the lower opening 32 of the shoulder connector 28.

The device next includes a flexible joint 40. With a top opening 42 and a bottom opening 44. It is connected to the respective upper tube 34 in the manner heretofore described. In particular, the inside diameter of the top opening 42 of the joint 40 is slightly larger than the outside diameter of the bottom opening 38 of the upper tube 34. This permits the upper tube 34 to be frictionally held by the joint 40. Conversely, the inside diameter of the bottom opening 38 of the upper tube 34 could be made slightly larger than the outside diameter of the top opening 42 of the joint 40 and the upper tube 34 could frictionally hold the joint 40 in position.

At the other end of the flexible joint 40 a lower tube 46 is connected. This connection is again made in the manner heretofore described. The inside diameter of the bottom opening 44 of the joint 40 is made slightly larger than the outer diameter of the top opening 48 of the lower tube 46. This permits the flexible joint to frictionally hold the lower tube 46. Alternatively, the lower tube 46 can frictionally hold the joint 40 in the situation where the inside diameter of the top opening 48 of the lower tube 46 is slightly greater than the outer diameter of the bottom opening 44 of the joint 40.

The upper and lower tubes 34 and 46 may typically be made of the same materials. They should be substantially rigid and may be made of plastic. Generally it is preferable for them to be made of a rounded cross section as this will provide the most optimum flow of air.

In the preferred embodiment, the flexible joint 40 may be a ribbed flexible hose that is bendable. This will allow an articulated connection between the upper and lower tubes 34 and 46.

If desired, the upper and lower tubes 34 and 46 and the joint 40 can be made as an integral tube with a flexible joint.

The collar 16 with the connector 18 and the shoulder connectors 28 may be made of any suitable material. In the preferred embodiments, they are made of plastic and in some cases may be made of hard rubber.

To assemble the device, the lower tubes 46 may be connected to the respective flexible joints 40. Then, the upper tubes 34 would be connected with the flexible joint. Thereafter, the upper tubes may be connected to the shoulder connectors 28, which in turn are then connected to the central portion 24. Because of the manner in which the shoulder connectors 28 are frictionally held in the central portion 24 of the connector 18, the central portion 24 can rotate or pivot about the central axis of the side openings 22 of the central portion 24 and the upper openings 30 of the shoulder connectors 28. This will permit the opening 20 in the inlet tube 26 to be moved from a vertical orientation to a horizontal orientation, as required.

After assembly of the unit, the lower tube 46 is inserted into the boot and pushed all the way forward until the bottom opening 50 of the lower tube 46 is in the vicinity of the toe region of the boot. The flexible joint 40 permits the proper articulation between the upper and lower tubes 34 and 46 to permit the lower tube 46 to be pushed inward into the boot.

In some embodiments, it may be desirable to include an aeration ball 52 at the bottom opening 50 of the lower tube 46. This may facilitate and better direct the flow of air around the inside of the boot. Such an aeration ball may be made of hard plastic or any other suitable material.

After the device is inserted into the boot, the air means 14 may be placed in communication with the opening 20 in the central portion 24 of the connector 18.

The air means 14 is simple in construction and requires, in its simplest embodiment, a motor and a fan. The motor would energize the fan in order to force the flow of air through the device in order to dry the inside of the boot.

In some embodiments, it may be desirable to include a coil to slightly heat the air in order to provide a more efficient drying of the inside of the boot or other article to be dried.

It has been determined that a simple hair dryer may be used as the air means. A typical hair dryer with a low wattage heating coil and appropriate fan speed can be positioned at the opening 20 of the central portion 24 of the connector 18 and this will typically provide a sufficient flow of air to dry the inside of a pair of ski boots in about thirty minutes.

As may be appreciated, skates, ski gloves or ski hats or any other article to be dried can be placed over the lower tube 46 for the purpose of drying the inside. If desired, additional tubes may be connected to the collar 16, so as to permit simultaneous drying of boots, gloves and other articles.

The various tubes and other parts may be made of any different size. Thus, the device can be made sufficiently small for use with ski boots of small children and sufficiently large to dry ski boots of the largest possible person.

If desired within the collar 16 in line with the flow of air, a deodorant impregnated sponge may be placed. This can be done for the purpose of deodorizing the air within the boot or other article to be dried. Similarly, the impregnated sponge can have a perfume to provide better odor for the air inside the boot or possibly a perfumed deodorant.

The invention is described in detail with reference to a particular embodiment, but it should be understood that various other modifications can be effected and still be within the spirit and scope of the invention.

I claim:

1. A portable dryer for drying moisture from the interior from an article to be dried, comprising air means; a distribution collar communicating with said air means; and articulated tubing having one end communicating with said distribution collar and a second end placed within the interior of the article to be dried; wherein said articulated tubing includes a non-flexible upper tubing having one end communicating with said distribution collar, a flexible joint having one end communicating with a second end of said non-flexible tube, and a non-flexible lower tube inserted within the article to be dried and having a first end communicating with said flexible joint and a second end from which air flows in to the article to be dried.

2. A portable dryer according to claim 1, wherein said distribution collar includes a connector having an inlet opening communicating with said air means and a plurality of outlet openings, and a shoulder connectors having inlet openings connected to outlet openings of said connector and outlet openings connected to an inlet opening of a respective upper tube of said articulated tubing.

3. A portable dryer according to claim 1, wherein said air means includes a motor and fan for propelling air through said distribution collar and said articulated tubing into the interior of the article to be dried.

4. A portable dryer according to claim 2, wherein said air means includes a motor and fan for propelling air through said distribution collar and said articulated tubing into the interior of the article to be dried.

5. A portable dryer according to claim 3, wherein said air means further comprises a coil for heating the air to be propelled into the interior of the article to be dried.

6. A portable dryer according to claim 4, wherein said air means further comprises a coil for heating the air to be propelled into the interior of the article to be dried.

* * * * *